United States Patent [19]

Orlando

[11] 4,394,935

[45] Jul. 26, 1983

[54] ZERO SETTING MECHANISM FOR SERVICE STATION PUMPS

[76] Inventor: Mario Orlando, 2320 E. North La., Phoenix, Ariz. 85021

[21] Appl. No.: 234,337

[22] Filed: Feb. 13, 1981

[51] Int. Cl.[3] ..... B67D 5/26

[52] U.S. Cl. ..... 222/35; 235/131 FD

[58] Field of Search ..... 235/131 R, 131 FD, 94 S; 222/35

[56] References Cited

U.S. PATENT DOCUMENTS

| | | | |
|---|---|---|---|
| 2,132,535 | 10/1938 | Logan | 222/35 |
| 2,232,820 | 2/1941 | Brouse | 222/34 |
| 2,311,905 | 2/1943 | Loder | 222/35 |
| 2,626,082 | 1/1953 | Bliss et al. | 222/34 |
| 2,712,884 | 7/1955 | Foss | 222/33 |
| 2,874,874 | 2/1959 | Markoff | 222/35 |
| 2,874,875 | 2/1959 | Markoff | 222/35 |
| 2,928,572 | 3/1960 | Markoff et al. | 222/35 |
| 3,008,608 | 11/1961 | Wilson et al. | 222/35 |
| 3,178,057 | 4/1965 | Nelson | 222/35 |
| 3,216,659 | 11/1965 | Ambler et al. | 222/35 |
| 3,349,963 | 10/1967 | Stasenko | 222/35 |
| 3,618,823 | 11/1971 | Kruckeberg | 222/33 |

*Primary Examiner*—David A. Scherbel

*Attorney, Agent, or Firm*—Cates & Roediger

[57] ABSTRACT

The connection between the actuating handle of a gasoline service station pump and the pump shaft is a lost motion connection wherein the pump may be actuated in the usual manner for turning the gasoline pump on but in returning the actuation handle to the vertical position, the connection between the handle and the pump shaft is floppy, i.e. a lost motion connection, so that the dial setting of the pump cannot be altered but the attendant can reset the indicating dials to zero and release the actuation lever for further operation by holding the actuating lever stationary, inserting a tool into the pump operating shaft and rotating the shaft and sleeve counter-clockwise a specified amount.

9 Claims, 23 Drawing Figures fig. 13e
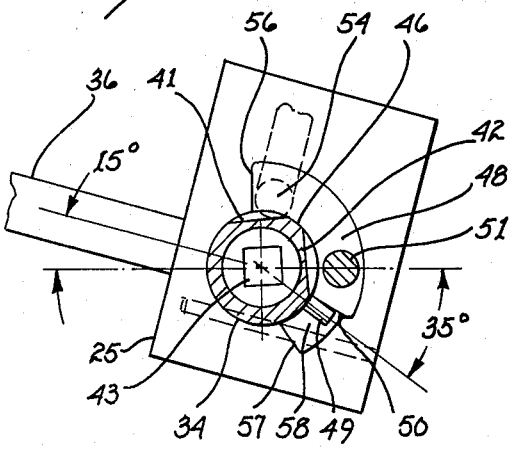
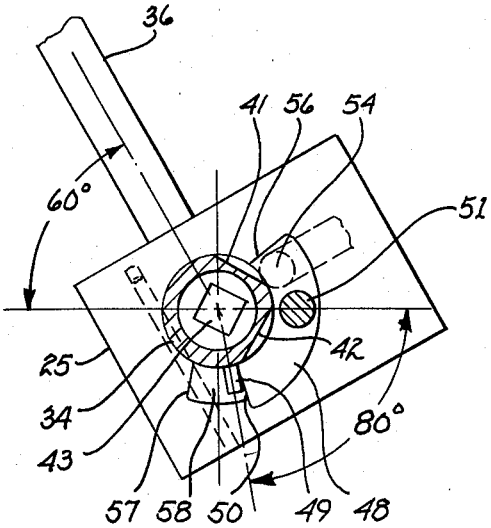
fig. 13f
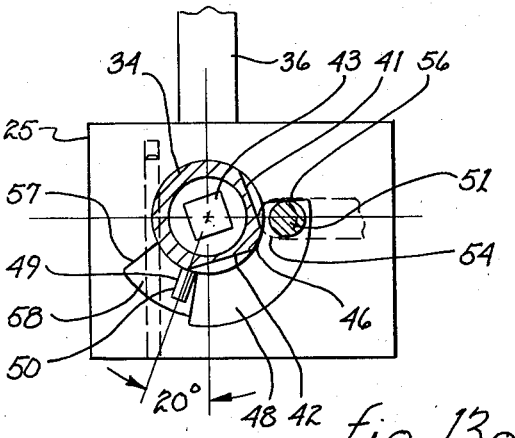
fig. 13g
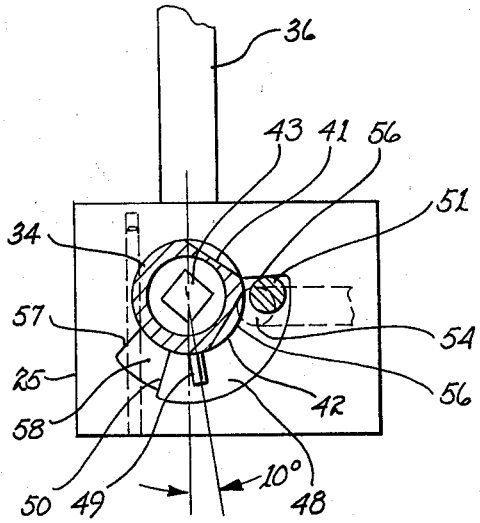
fig. 13i
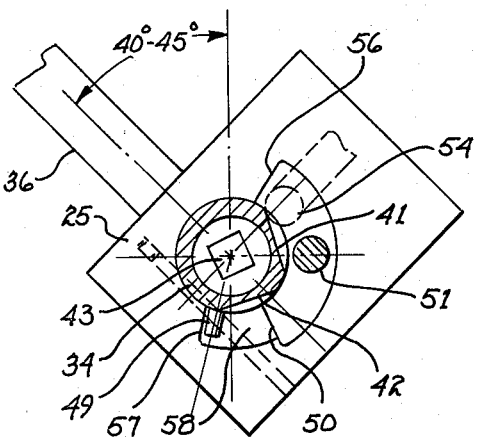
fig. 13h

ZERO SETTING MECHANISM FOR SERVICE STATION PUMPS

BACKGROUND OF THE INVENTION

This invention relates to automobile gasoline pump actuating handles, and it is an object of the invention to provide an improved actuating handle of this nature which substantially reduces the likelihood of cheating by unscrupulous operators or customers of the gasoline pumps.

In recent times, self service gasoline pumps have become the vogue in automobile service stations. Typically, in such installations, the customer or person buying gasoline, herein sometimes called the "operator" drives into a service station and stops his automobile adjacent to a particular pump. The pump indicating dials usually, if not always, show the numbers applicable to the preceding transaction, even though the pump has been released for use by the operator. It is, of course, possible for the service station attendant to set the indicating dials to zero at about the time that the attendant releases the pump after use by a particular operator. However, in most instances, as indicated, the pump is reset for use by a subsequent operator but the dials are not reset to zero. The reason for this is practical as may be explained. The pump actuating lever, when released by the attendant, can be turned from its vertical position to its horizontal position (counter-clockwise) after the pump nozzle is removed from its recess. Part way through the indicated motion, the pump itself is actually turned on and the dials reset themselves to zero with the exception of the dials showing the cost in dollars per gallon for each gallon of gasoline. To have the pump indicating dials set to zero and have the pump actuating handle in its vertical position either locked or unlocked requires additional operations on the part of the service station attendant as described, and as a result the pump indicating dials are usually not set to zero before a customer comes in to use the pump.

This may be visualized further by considering the sequence of operations when an operator comes in to the service station to purchase gasoline. In such instance, as has already been indicated, the operator removes the pump handle from its recess, puts the nozzle into the tank opening and rotates the pump actuating handle counter-clockwise by ninety degrees from its vertical to its horizontal position. This, of course, assumes that the service station attendant has released the actuating handle. If not, the service station attendant will come to the pump, insert a key and release the handle following which the indicated motion takes place. In moving the actuating handle or lever from its vertical to its horizontal position the gasoline pump is actually energized and the dials are set to zero.

Thereafter, the operator depresses the handle on the pump nozzle initiating gasoline flow into the automobile tank until the desired amount of gasoline has been pumped whereupon the operator releases the handle on the pump nozzle and the gasoline flow stops. The indicating dials at this point indicate the number of gallons pumped and the dollar value thereof. The operator then rotates the pump actuating handle from its horizontal position to its vertical position which movement removes the handle obstruction from the pump nozzle recess and the operator may replace the nozzle into that recess. In this same motion, the pump is de-energized but the indicating dials remain as they were in order to show the transaction so that the service station attendant can come over and charge the operator for the gasoline taken. When the actuating handle has been moved to its vertical position, it becomes locked there and cannot be moved again for a subsequent operator until the handle has been released by the service station attendant. This, the attendant does by inserting the key into an appropriate opening in the pump actuating handle, turning the key to release the handle so that its subsequent operator may come in and take gasoline from the pump. In this initial operation by the attendant, that is to release the pump actuating handle, the dials do not reset to zero but remain showing the just occurred transaction. If the attendant wishes to reset the dials to zero so that they show zero transaction for the next operator, it is necessary for the attendant to remove the nozzle from its recess, rotate the actuating handle some portion counter-clockwise, such for example sixty degrees of the total ninety degree movement available. This movement resets the dials to zero and of course turns the pump on so that it could pump gasoline. Thereupon the attendant returns the handle to its vertical position which deactivates the pump, he replaces the pump nozzle in its recess and inserts his key into the provided opening in the pump actuating handle and rotates the key to release the handle. The pump is now in condition for pumping gasoline for another operator and the dials are at zero.

It is to be emphasized however that in this description of the necessary operating steps, two releases of the pump actuating handle are required as well as a partial rotation of the pump actuating handle and a return to its vertical position with the concomitant necessary to remove the pump nozzle from its recess and to replace it. As a result of these required additional steps, it is most usual for service station attendants merely to release the handle in order that subsequent operation can take place without going to the additional steps required to reset the dials to zero. Accordingly, the dials are not reset to zero until the next operator removes the pump nozzle from its recess and rotates the pump actuating handle from its vertical to its horizontal positon.

The foregoing steps and conditions make it possible for unscrupulous individuals to cheat and defraud the service station owner and attendants. When there are two or more pumps in a line or an island in the service station, an unscrupulous operator can drive in to one pump and take gasoline from it, for example ten gallons, replace the pump nozzle in its recess after turning the pump off by the operating handle, and move ahead to another pump which shows the gasoline taken by the previous operator or customer. Assume that the dials in the second instance are less than the indication on the dials of the pump actually used by the unscrupulous operator, he can then say to the attendant at the service station that he took gasoline only from the second pump. While upon investigation it may be established that this could not be the case because the first pump used by the unscrupulous operator has its actuating handle locked whereas the second does not; or in an alternative situation if the unscrupulous operator has actually taken a small amount of gasoline from the second pump, the attendant is then faced with two pumps from which the indicating dials show that gasoline has been taken and the unscrupulous operator insists that he has taken only from the second pump. In order to avoid this kind of disagreement between customer and attendant, it is desirable that whenever the pump handle is released, the indicating dials be reset to zero. Thus, when an unscrupulous operator comes in and takes gasoline from one pump and moves forward to a second pump and takes gasoline from that, he cannot argue with the attendant that he did not take gasoline from both pumps because the dials would otherwise be at zero. While this is not a fool-proof condition or situation, it nevertheless removes one substantial source of argument found by the inventor to be the case, and it substantially reduces the likelihood of cheating by such unscrupulous operators of the gasoline pumps.

SUMMARY OF THE INVENTION

It is a further object of the invention to provide an improved automobile service station pump actuating handle wherein by a single action of the service station attendant, the pump actuating handle is released or reset for a subsequent actuation of the pump and the pump indicating dials are reset to zero.

It is a further object of the invention to provide an improved automobile service pump actuating handle that eliminates the typical latch for latching the actuating handle in the vertical position following use of the pump by an operator thereof.

It is a further object of the invention to provide an improved automobile service station gasoline pump actuating handle of the character described which is simple in construction and easy to operate. At the same time, it is an object of the invention to provide such an improved actuating handle which in practice substantially reduces the incidence of cheating by purchasers of gasoline from a particular pump.

In carrying out the invention according to one form, there is provided an actuating mechanism comprising an actuatable shaft, an actuating member adapted to rotate a predetermined distance in one direction and the reverse thereof, a coupling element between said actuatable shaft and said actuating member and attached to, the actuatable shaft, the coupling element and the actuating member being adapted to move relative to each other, movable stop means on the coupling elements, fixed stop means for engagement by the movable stop means, interengaging means between the coupling element and said actuating member having one position for effecting movement of the coupling element upon movement of the actuating element until engagement of the fixed stop by the movable stop, whereupon relative movement in one direction occurs between the coupling element and the actuating element, the interengaging means having a second position for effecting movement of the coupling element in the reverse direction upon movement of said actuating elements in the reverse direction to a predetermined position, and means for moving the interengaging means from the second position to the one position while holding the actuating member stationery.

In carrying out the invention according to another form, there is provided in a gasoline service station pump actuating mechanism wherein during operation, the nozzle is removed from its recess, an actuating lever is rotated ninety degrees on a pump shaft in one direction to activate the pump during part of the lever rotation and to set the indicating dials to zero before gasoline flow takes place and in the reverse direction of the lever to an off position to deactivate the pump and to lock the lever in the off position to require the release of the lever lock before further pump activation can occur, the improvement for assuring that the indicating dials are set to zero when the activating lever is released comprising a lost motion connected between the pump shaft and the actuating lever, said lost motion connection comprises an abutment means on the shaft separating first and second lost motion connection areas and releasable means on the actuating lever for riding on the first lost motion connection area engaging the abutment means and causing the pump shaft to rotate upon rotation of the actuating lever, a movable stop on the pump shaft, a fixed stop on the pump, the movable stop being located relative to the fixed stop to effect engagement of the stops and discontinuance of pump shaft rotation part way during the ninety degree rotation of the actuating lever, continued rotational movements of the actuating lever disengaging the releasable means from the abutment means and shifting the releasable means to the second lost motion connection area on the pump shaft, on the reverse movement of said actuating lever the releasable means rides on the second lost motion connection area, engages the abutment means and causes the pump shaft to rotate to the pump off position while the relesable means remains on the second lost motion connection area, and means on the pump shaft for enabling the pump shaft to be rotated in the pump actuation direction while holding the actuating lever stationery, thereby to move the releasable means from the second lost motion connection area to the first lost motion connection area and setting the indicator dials to zero.

The invention, further, is carried out by the provision wherein the lost motion connection comprises a sleeve fitting over and attached to the shaft, the sleeve including the abutment means and the two lost motion connection areas one on each side of the abutment means.

BRIEF DESCRIPTION OF THE DRAWINGS

For a more complete understanding of the invention, references should be had to the accompanying drawing in which:

FIGS. 13*a*–13*i* are diagramatic sectional views which in succession show structure and various operating positions of the actuating handle throughout a complete cycle of utilization.

DESCRIPTION OF THE PREFERRED EMBODIMENTS

Figure 2:
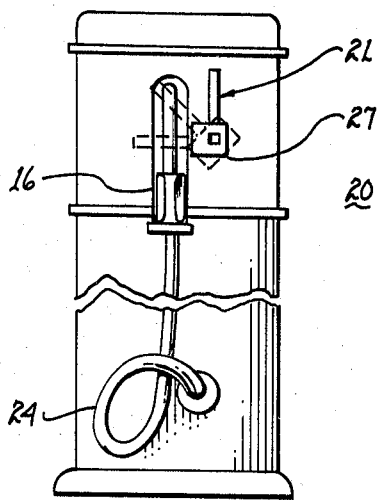
FIG. 2 is a side view of the pump shown in FIG. 1.

Referring to the drawings there is shown a typical automobile service station gasoline pump 20 including the pump's actuating handle 21 according to the invention. The pump 20 includes the usual three sets of dials 22—one, labeled Dols, showing the amount of the complete transaction, another labeled Gals, showing the number of gallons pumped, and a third labeled $/Gal indicating the price of gasoline per gallon. The pump includes a typical pump nozzle 23 connected to a hose 24 which extends from the base 25 of the pump, all as is well understood in this art. The pump nozzle 23 in its unused position is disposed in a recess 26 along side of which is disposed the pump actuating handle 21 which is pivotally, or rotatably, mounted on a pump shaft 27 also as is well understood. The actuating handle 21 is shown in FIG. 2 as having a vertical position, a horizontal position and a position in between which are part of the movements of the actuating handle during the operation of turning the pump on and off and resetting for subsequent use. The pump shaft 27 with the handle 21 attached is shown diagrammatically in FIG. 3 and extending from the pump shaft 27 are dotted lines 27*a*, 27*b*, 27*c* which illustrate the performance, typically, of the necessary functions during the operations of a gasoline pump. Thus, for example, the dotted line 27*a* extending from the pump shaft 27 goes to the Dols or total transaction value dial of the indicating dials 22. The dotted line 27*b* extends to the Gals or gallons indicating dial of the dials 22 and the dotted line 27*c* extends to the pump 28 which actually pumps the gasoline when the lever 29 on the pump 23 is depressed, as as is well understood in this art.

Figure 3:
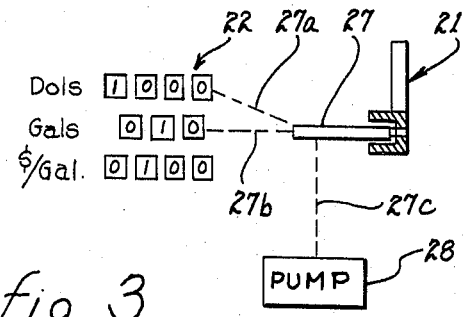
FIG. 3 is a diagrammatic view of the indicating dials of a pump and an actuating handle according to the invention.

The dollars per gallon indicating dial of the dials 22 is not connected to the pump shaft 27 because these dials are set manually for the cost per gallon whenever these numbers change in order to conform to the current price of gasoline. In the indicating dials 22 as shown in FIG. 3 the dollars per gallon shows one dollar, the number of gallons of the transaction shows as 10, and the total dollars of the transaction is shown as ten dollars. Obviously, this is an exemplary case for purpose of illustration only. As indicated in connection with the description of FIG. 2, the actuating handle 21 moves from a verticle position to a horizontal position and in the reverse, carrying the shaft 27 along with it as will be more particularly described and actuating the indicating dials 22 and the pump 28 as is well understood.

Figure 4:
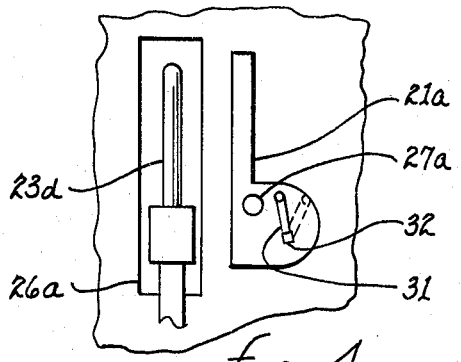
PRIOR ART fig. 4
FIG. 4 is a diagramatic illustration, partially, of a typical gasoline service station pump.

In FIG. 4 there is illustrated a typical pump nozzle 23*a* disposed in a recess 26*a* and a pump actuating handle 21*a* operating a pump shaft 27*a* all for a prior art installation of a typical nature. In the operation of the illustrated device shown in FIG. 2, as is well known, the pump nozzle 23*a* is removed from the recess 26*a* and is inserted into the opening in the customer's fuel tank. As part of this process the handle 21*a* is rotated from the vertical position shown in FIG. 4 to a horizontal position as may be visualized by considering FIG. 2. Before the handle 21*a* can be moved, that is to say rotated counter-clockwise from the position shown in FIG. 4, the latch, or lock mechanism, 31 first has to be released by the service station attendant, also as is well understood. When the latch 31 is released, the indicating dials 22 remain in their previously set condition and are not reset, the handle may be rotated counter-clockwise as is understood. The initial portion of the movement counter-clockwise produces no changes in the indicating dials nor in the pump 28. However, when the actuating lever 21*a* is moved somewhere between forty-five and sixty degrees counter-clockwise, the pump 28 is turned on and the dials 22 are reset to zero, so that when the lever 21*a* has been rotated to its horizontal position (FIG. 2) the pump is turned on, the dials are reset to zero and the customer, the operator of the pump, can squeeze the appropriate lever on the nozzle 23 and put gasoline into his automobile gasoline tank. When this operation has been completed, the operator, namely the customer, rotates the lever 21*a* clockwise and at some point—say thirty degrees from horizontal, the pump 28 is turned off and the handle 21*a* is continued to be moved toward its vertical or upright position.

The indicating dials 22 however remain at their transactional position. When the actuating handle 21*a* reaches its vertical position, the handle is locked in the vertical position by the latch 31*a*. Thus, in the final stage of the gasoline purchasing operation, the indicating dials 22 remain at the transactional position and the handle 21*a* remains in its vertical locked position. Ordinarily, as has already been indicated, the service station attendant at this point comes to the pump area and by inserting his tool into the opening 32 and rotating it, he can release the latch 31 thereby enabling the actuating lever 21*a* to be again rotated to the starting position. However, if the dials are to be set to zero at this stage, the pump nozzle 23*a* has to be removed from its receptacle or recess 26*a* and the actuating handle 21*a* rotated approximately sixty degrees to cause the pump 28 to turn on and the dials 22 to turn to zero. Now, the attendant would again rotate the actuating lever 21*a* to its vertical position, and replace the nozzle 23*a* into the receptacle 26*a*. Moving the actuating lever 21*a* to the vertical position at this time again causes the match mechanism 31 to lock the lever 21*a* in its vertical position whereupon the service station attendant must again release the latch 31 by inserting the tool into the opening 32 and moving the latch to its inactive position. Thus, to return the indicating dials to zero and to release the actuating handle 21*a* requires the additional operations by the service station attendant, namely remove the nozzle 23*a*, rotate the actuating handle 21*a*, again rotate the actuating handle 21*a* to the vertical position, replace the nozzle and further release the latch 31.

The handle according to the invention eliminates the additional motions such as removing of the nozzle 23*a* from the recess, rotating the actuating handle 21*a*, counter rotating it to the vertical position and resetting the latch in order to achieve the situation where the indicating dials are at zero when the actuating lever 21*a* is in the position for a customer to purchase gasoline.

Figure 5:
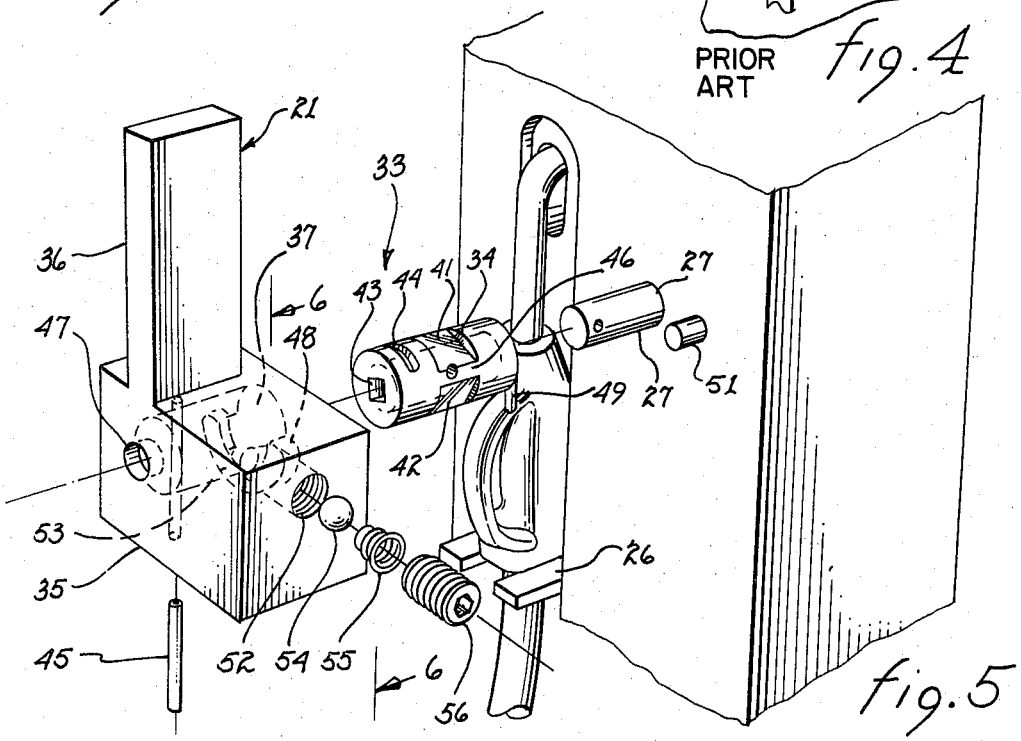
FIG. 5 is an exploded view on a larger scale of the actuating handle mechanism, according to the invention, illustrated in FIG. 2.
Figure 6:
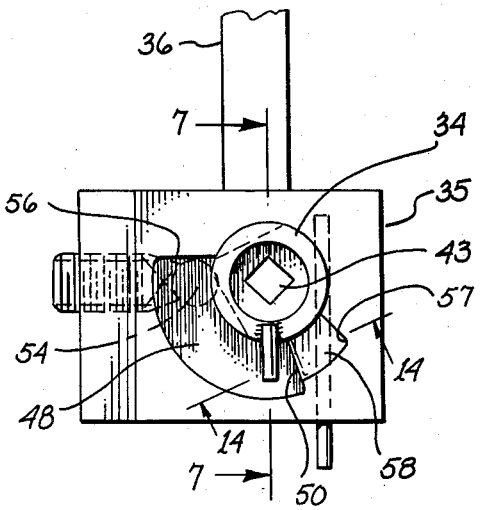
FIG. 6 is a view taken substantially in the direction of arrows 6—6 of FIG. 5.
Figure 8:
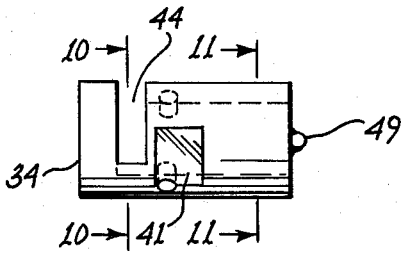
FIG. 8 is a plan view of one of the operating components according to the invention.
Figure 9:
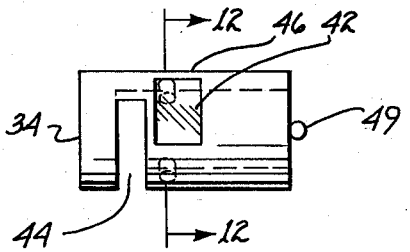
FIG. 9 is a plan view similar to FIG. 8 but taken in the reverse direction.
Figure 7:
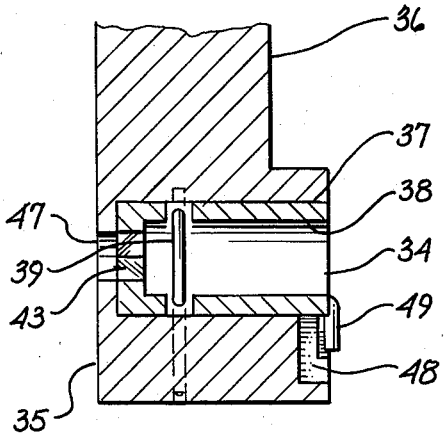
FIG. 7 is a sectional view taken substantially in the directions of arrows 7—7 of FIG. 6.
Figure 10:
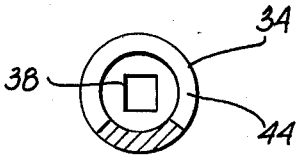
FIG. 10 is a sectional view taken substantially in the direction of the arrows 10—10 of FIG. 8.
Figure 11:
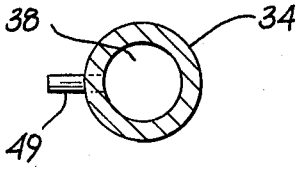
FIG. 11 is a sectional view taken substantially in the direction of arrows 11—11 of FIG. 8.

The benefits of the invention are obtained by providing the actuating handle 21 together with a lost motion connection 33 between the handle 21 and the pump shaft 27. The lost motion connection 33 includes a sleeve member 34, a cooperating cylindrical opening 37 inside of the handle 21 and certain other components as will be described. The pump shaft 27 as illustrated in the FIG. 5 is the same pump shaft as shown in FIG. 2, and corresponds also to the pump shaft 27*a* of FIG. 4, namely the standard, ordinary, garden-variety gasoline service station pump. In FIG. 5, according to the invention, the pump nozzle 26 is shown in the receptacle, or recess, 26 in the customary manner. The inventive handle 21 and its lost motion connection 23 are intended to be fitted over the regular pump shaft 27 without modification of the internal mechanism of the pump itself. The handle 21 and the lost motion connection 33 may be understood by considering the FIGS. 5 thru 12 inclusive and the operation of the structure may be understood by considering FIGS. 13*a*–13*i*.

Thus, the handle 21 includes a base 35 and a handle extension 36, the base 35 including the cylindrical opening 37 which rotatively, slidably and easily receives the sleeve 34 as may be visualized in FIG. 5. The sleeve 34 includes a central opening or bore 38 which easily receives the pump shaft 27 so that the pump shaft 27 and the sleeve 34 may be pinned together as by a pin 39. The sleeve 34 and the pump shaft 27, accordingly, move together whenever the lever 31 is actuated. The sleeve 34 includes a pair of flat surfaces 41 and 42 which are disposed on the surface of the cylindrical sleeve 34 and are about at right angles to each other or somewhat less as will be understood. In addition, the sleeve 34 includes a rectangular opening 43 and a transfer slot 44 which is of a greater circumferential extent than one-hundred eighty degrees and is the slot through which the pin 45 in the base 35 is received in order to hold the sleeve 34 assembled to the base 35, as will become clear. The flat surfaces 41 and 42 come together, in effect, at an apex or obstruction 46 for a purpose to be described. The rectangular slot 43 becomes disposed immediately inside of and adjacent to the opening 47 through which the service station attendant's tool is received and into the rectangular opening 43, for resetting the gasoline pump for a subsequent customer, as will be understood. The interior of the base 35 of the handle 31, in addition to the cylindrical bore 37, includes an essentially semi-cylindrical slot or groove 48 which is a radial extension of the bore 37 adjacent to the inner edge of the base 35. The cylindrical slot or groove 48 is intended to receive the movable stop 49 attached to the inner end of the sleeve 34 and the stationary pin 51, or stop, attached to the pump housing proper. The slot 48 includes two ends 56 and 57 and a wall 50 forming a space or shelf 50*a*. The wall 50 is adapted to abut pin 51 and the shelf provides a relief space for the movable pin 49.

In addition the handle base 35 includes a threaded bore 52 terminating in a circular opening 53 disposed at the interior of the cylindrical opening 37. A spherical ball 54 is received through the threaded bore 52 and rests in the circular opening 53, and a spring 55 is received within the bore 52 and contacts the spherical ball 53. A setscrew 56*a* is received in the threaded bore 52 thereby causing the spring 55 to engage the spherical ball 54 which is received in the circular opening 53. As may be visualized in comparing FIGS. 5 and 6, in the assembled condition, the sleeve 34 is received within the bore 37, and the ball 54, in the starting position, engages the flat surface 42 and the beginning of the abutment or ridge 46.

With the structure of the sleeve 34, the pump shaft 27, and the bore 37 etc. etc. inside of the base 35 of the actuating handle as described, additional structure and the functioning or operation may be considered by referring to FIGS. 13*a*–13*i*.

In FIGS. 13*a*–13*i*, a diagrammatic sectional view, somewhat modified for inclusion of structure and explanation, is shown successively in order to continue the explanation of the invention. Thus these figures, in effect, show a sectional view through the sleeve 34 to show the flat surfaces 41 and 42 on the cylinder ending in the abutment or ridge area 46. A vestige of the ball 54 is shown in contact with the flat surface 42 against the abutment 46, a vestige of the bore 52 is shown and the stationary stop 51 attached to the pump is shown adjacent one end 56 of the slot or groove 48. The end 56 of slot bears against pin 51 and forms a stop for the handle 36, preventing any further clockwise rotation. The rectangular opening 43 of the sleeve 34 is also shown as is the movable stop 49 attached to the sleeve 34. In this view, the base 35 and the handle extension 36 are included to provide the total environment for considering the additional structure and operation. Further, it should be understood that the views as shown in FIGS. 13*a*–13*i* are as though an observer were facing the pump during operation and were moving the handle in the same manner as the handle is moved during operation of the pump by a customer purchasing gasoline.

Thus, in FIGS. 13*a*–13*i*, it should be considered that the pump shaft 27 is pinned to the sleeve 34 and the sleeve 34 is joined to the base 35, handle 36, by the pin 45 in the lost motion connection 33 including the slot 44.

Figure 1:
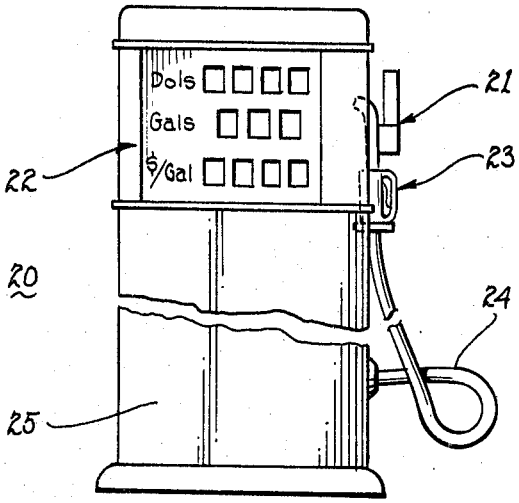
FIG. 1 is an elevational view of a typical gasoline pump, according to the invention, as utilized in an automobile service station.
Figure 13A:
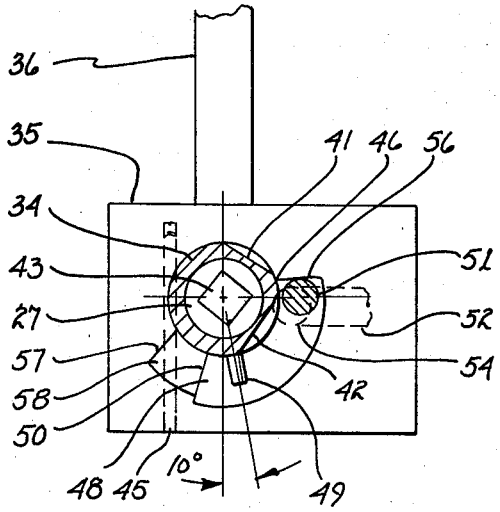

FIGS. 13*a*–13*i* should be considered in connection with FIGS. 1, 2 and 3 in understanding the operation of the invention. In FIG. 13*a* the handle 36 is vertical and corresponds to the position of handle 21 as shown in FIGS. 1, 2 and 3. For purpose of understanding this step of the inventive structure, it is immaterial whether the dials 22 of FIG. 3 show any numbers on the dollars or total transaction dials as well as on the dials showing the number of gallons. Referring to FIG. 13*a*, the edge or end 56 of slot 48 abuts the fixed stop 51 so that the handle 36 is held in its vertical or upright position without any additional stops being necessary. It is assumed that the pump handle has been released and the pump is ready for operation upon a customer or operator coming into the service station and disposing the nozzle 23*a* into the opening of his automobile gas tank.

Figure 13B:
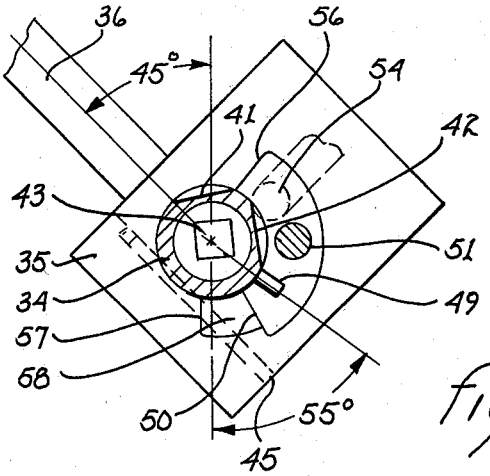

THe first operative step is to rotate the handle 36 counter-clockwise by about forty-five degrees as shown in FIG. 13*b*. In effect, in most gasoline pumps this is idle motion since rotation of the handle to this extent does not effect turn-on of the actual gasoline pump 28 nor does it cause resetting of the indicator dials if they are not in fact at zero. Note, however, in comparing FIGS. 13*a* and 13*b*, that the spherical ball 54 has moved with the base 35 and by virtue of its contact with the abutment or obstruction 46, has carried the sleeve 34 counter-clockwise forty-five degrees and thus the pump shaft 27 has likewise rotated forty-five degrees counter-clockwise. The pin 49 has moved forty-five degrees to a position about fifty-five degrees from the lower vertical because it had an initial position of ten degrees away from this same vertical. Up to this point of rotation of the handle 45 nothing has occurred.

Figure 13C:
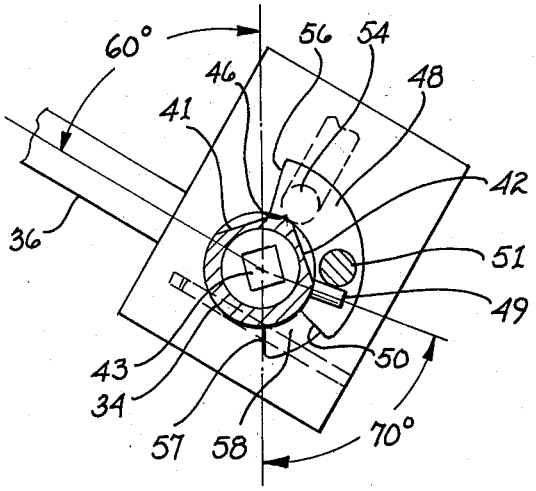

Referring next to FIG. 13*c*, it will be observed that the handle 36 has rotated an additional fifteen degrees to a position sixty degrees from vertical. During this portion of the rotation the indicator dials 22 will have been reset to zero and the pump 28 turned on by appropriate mechanism (not shown) but illustrated in FIG. 3 by the dotted lines 27*a*, 27*b* and 27*c* in accordance with well understood operations of gasoline pumps.

Figure 14:
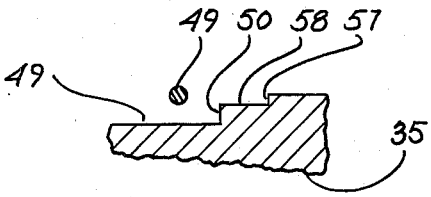
FIG. 14 is a fragmentary sectional view taken substantially in the direction of arrows 14—14 of FIG. 6.
Figure 12:
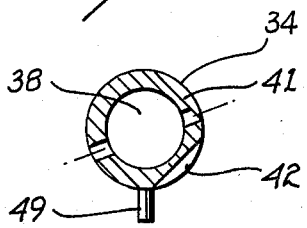
FIG. 12 is a sectional view taken substantially in the direction of arrows 12—12 of FIG. 9.
Figure 15:
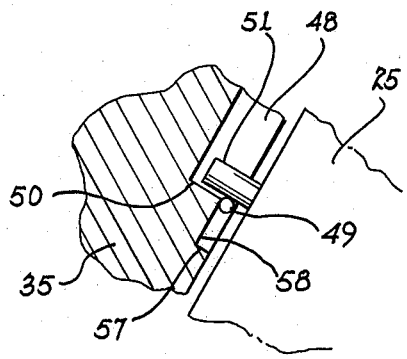
FIG. 15 is a fragmentary sectional view taken substantially along the lines 15—15 of FIG. 3*d*.

It will be noted that the spherical ball 54 is still on surface 42 and in contact with the obstruction 46. Attention is directed however, in FIG. 13*c*, to the fact that the movable stop 49 has come into contact with the fixed stop 51. Continued rotation of the handle 36 and base 35, now, does not rotate sleeve 34 any further in the counter-clockwise direction. The handle 36 would not remain in the position shown in FIG. 13*c* but would tend to move in the reverse under the influence of spring biases existing on the various shafts, so the handle 36 is continued to be moved in the counter-clockwise by an additional thirty degrees to bring it into the position shown in FIG. 13*d*. During the movement from the position shown in FIG. 13*c* to that shown in FIG. 13*d*, the ball 54 has moved over the abutment area 46 from the flat surface 42 to the flat surface 41. The pin 49 remains against the fixed stop 51 and the wall 50 of slot 48 has moved into contact with the pin 51 thereby preventing any further movement of the handle 36 and the base 35. When the wall 50 moves to engage stop pin 51, the shelf 58 moves underneath pin 49, as may be visualized in considering FIGS. 14 and 15 along with FIG. 13*d*.

After the operator, namely the customer, has taken whatever amount of gasoline he wishes, which amount will show on the indicating dials 22, the operator of course stops the flow of gasoline by releasing the latch on the nozzle handle as is well understood, removes the nozzle from the opening in the automobile gasoline tank and attempts to replace the nozzle in the recess 26*a* in the pump casing. Before performing the latter, the operator (customer) must rotate the handle 36 and base 35 clockwise from the position shown in 13*d* through the positions shown in FIG. 13*e* to FIG. 13*h*, the latter corresponding to the showing in 13*a*.

The movement clockwise of the handle 36 of about fifteen degrees is shown in FIG. 13*e*. It is during this portion of the movement that the pump handle causes the pump 28 to turn off and the indicator dials 22 to remain in their final position. This is exemplified by the dotted lines 27*a*, 27*b*, and 27*c* in FIG. 3. This function is achieved as may be visualized in FIG. 13*e* by the fact that the spherical ball 54 remains in contact with the second side of the obstruction 46 by virtue of the ball being on the first flat surface 41. The movable stop 49 will have moved away from the fixed stop 51 by the same amount fifteen degrees. As shown in FIG. 13*e*, the pin 49 has moved to a position of about thirty-five degrees away from the horizontal axis, it having had a position of about twenty degrees in this location as may be seen in FIG. 13*d*.

The next step in the turn-off and deactivation of the pump is shown in FIG. 13*f* wherein the handle 36 is shown in a position sixty degrees from horizontal, after a movement of forty-five degrees from the position shown in FIG. 13*e*. The sleeve 34 has been carried clockwise in the motions described by virtue of the spherical ball 54 bearing against the obstruction or abutment 46 as described. If the pump motor has been turned off and the dials inactivated as already described by the motion as shown in FIG. 13*e*, no further function occurs in the motion from FIG. 13*e* to FIG. 13*f*. However, the pump 28 could have been turned off and the dials remain in their sale-indicating positions by the motion from 13*e* to 13*f*. The final movement in the turn-off actuation of the pump occurs between FIGS. 13*f* and 13*g* wherein in FIG. 13*g* the pump handle 36 is again vertical, sleeve 34 occupies the position shown in FIG. 13*g* with the movable pin 49 in about a position twenty degrees clockwise from the lower vertical. This was achieved by the ball 54 continuing to bear against the obstruction 46 while riding on the first flat surface 41. In this position the end 56 of slot 48 engages pin 51, preventing any further clockwise movement of handle 36. It is to be noted that the indicating dials 22 remain in their operated position, namely showing the number of gallons taken and the total amount of the transaction. In other words, there has been no resetting of the pump indicating dials. Any operator, customer, would not be able to point to the pump and indicate that he had not taken the amount of gasoline indicated, because the dials initially were at zero.

Figure 13D:
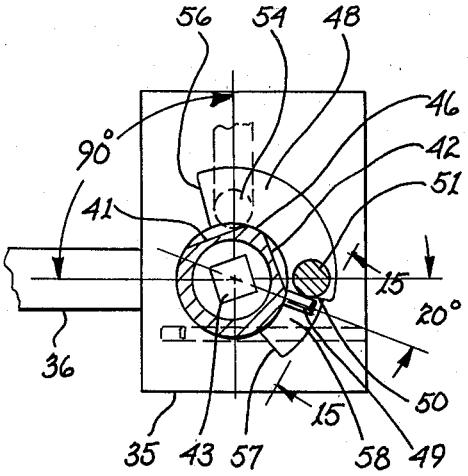

In the motion of the handle 36 from the position shown in FIG. 13*d* to that shown in FIG. 13*g*, the lost motion coupling between the sleeve 34 and the handle base 36, 35 has been by virtue of the ball 54 riding on the flat surface 41. In the movement as between FIGS. 13*d* to 13*g*, the sleeve 34 has moved with the handle 36. When the handle 36 reaches the vertical position as seen in FIG. 13*g*, and the indicator dials 32 have reset and the pump 28 has turned off, any effort to turn the handle 36 counter-clockwise to turn the pump on again will not succeed because the ball 54 merely rides idly, counter-clockwise in effect, on the flat surface 41 as may be seen in FIG. 13*h*. The pin 49 rides onto the shelf or space 50*a*. This motion may be termed free play. Movement of the ball 54 from the obstruction 46 toward the other end of the flat surface 41, about forty to forty-five degrees, typically, will result in no movement of the sleeve 34 at all. When the ball 54 reaches the other end of the flat 41 the sleeve 34 will rotate with further movement of the handle 36 and the end 57 of slot 48 engages the movable pin 49. As will be recalled by considering FIGS. 13*a* and 13*b*, the sleeve can move forty-five degrees in the counter-clockwise direction without turning the pump 28 on or doing anything to the indicating dials 22. Thus the handle 36 can rotate in the counter-clockwise direction virtually a full ninety degrees of arc from the position in FIG. 13*c* without turning on the pump motor 28 or altering the setting of the indicator dials. The actuation of the handle 36 in this phase may be termed floppy motion as a result of the lost motion connection, but the operator, customer, cannot turn the pump on again until the attendant of the service station comes and resets the mechanism as will now be described.

The resetting of the mechanism including conditioning of the components so that the pump motor 28 can be turned on and the indicating dials 22 reset, requires that the attendant insert a square tool (not shown) in the square slot, or hole, 43 and while hand holding the handle extension 36 rotate the sleeve 34 counter-clockwise. This counter-clockwise movement or rotation of sleeve 34 causes the abutment or obstruction 46 as shown in FIG. 13*g* to move beyond the spherical ball 54 until the flat surface 42 comes underneath the ball 54 as shown in FIG. 13*i*. This requires a movement of the sleeve of about thirty degrees namely from about the twenty degree position shown in FIG. 13*g* to the ten degree position shown in FIG. 13*h*. This movement, in effect, causes the sleeve 34 to be tied or linked to the base 35 and the extension handle 36 by virtue of the connection between the ball 54 and the abutment 46 as has already been described.

In the condition shown, in FIG. 13*i*, however, and while the attendant has his tool inserted in the rectangular or square hole 43, the sleeve can be rotated counter-clockwise by an amount determined by the length of the flat surface 42 and in any event about sixty degrees. This movement counter-clockwise is sufficient as will be understood by considering FIG. 3 and FIGS. 13*a*–13*c* to reset the dials 22 thru the linkages illustrated diagramatically by the dotted lines 27*a* and 27*b* in FIG. 3 as is well understood. At this point the dials 22 going to zero establish that a condition desired by the invention has been achieved. Namely, when a second operator, customer, comes into the service station he finds that the pump dials are at zero even though the handle 36, 21, has been released and reset so that the pump is in condition for operation by that customer. During the operation by the attendant to move the obstruction 46 from the front of flat surface 41 to the front of flat surface 42 and beyond, the sleeve 34 and the base 35 have a lost motion or idle motion connection between them.

It will be observed that the change in position of the sleeve 34 with respect to the spherical ball 54, which is to say that the indicating dials have been set to zero and the handle released so that the next customer can take gasoline, has taken place without the attendant having to remove the nozzle 23*a* from its recess 26*a*. That is to say in a single motion, the attendant has been able to reset the dials to zero and reset the pump for further operation without removing the nozzle from its receptacle. Thus one of the objections of the prior art has now been obviated.

When a purchaser of gasoline comes into the service station where the inventive pump handle has been installed, the purchaser will observe that all of the pump dials are at zero. When that purchaser takes gasoline from a pump, the dials indicate the amounts of his purchase and when the pump handle is returned to its vertical position, the dials remain as indicated but the handle is floppy, that is to say, it has lost motion or free play in its connection with the pump shaft and the dials cannot be altered. Thus a purchaser of gasoline going to a second pump cannot state that he has not taken the gasoline from the first pump because the dials show the purchase and all other dials show zero. A common source of cheating has thus been obviated.

While the member 46 has been referred to as a ridge or abutment, it is clear that, as shown, it is the regular curved surface of the sleeve 34 that exists between the flat surfaces 41 and 42. Member 46 serves as a ridge or abutment in its resistance to movement thereover of the ball 54.

While in the invention as described the sleeve 34 is utilized to provide the lost motion connection between the pump shaft and the actuation handle, it will be understood that other arrangements may be used, for example, the pump shaft 27 itself may have corresponding flat surfaces 41 and 42 disposed thereon and the spherical ball 54 may be moved from one of these surfaces to the other during the operation as described.

Also, if the flat surfaces 41 and 42 were to be eliminated, i.e. remain circular, the abutment 46 could be replaced by a slight ridge.

I claim:

1. An actuating mechanism comprising an actuatable shaft, an actuating member adapted to rotate a predetermined distance in one direction and the reverse thereof, a coupling element between said actuatable shaft and said actuating member and attached to said actuatable shaft, said coupling element and said actuating member being adapted to move relative to each other, movable stop means on said coupling element, fixed stop means for engagement by said movable stop means, interengaging means between said coupling element and said actuating member having one position for effecting movement of said coupling element upon movement of said actuating element until engagement of said fixed stop by said movable stop, whereupon relative movement in one direction occurs between said coupling element and said actuating element, said interengaging means having a second position for effecting movement of said coupling element in the reverse direction upon movement of said actuating element in the reverse direction to a predetermined position, and means for moving said interengaging means from said second position to said one position while holding said actuating member stationary.

2. The actuating mechanism according to claim 1 wherein said coupling element comprises a sleeve member, and said interengaging means comprises a pair of flat surfaces on said sleeve member and a spring biased ball carried by said actuating member, said ball being biased into engagement with either of said flat surfaces, and being adapted to move from one of said flat surfaces to other.

3. The actuating mechanism according to claim 1 wherein said interengaging means comprises a pair of flat surfaces on said shaft and a spring biased ball carried by said actuating member, said ball being biased into engagement with either of said flat surfaces, and being adapted to move from one of said flat surfaces to the other.

4. An actuating mechanism comprising an actuatable shaft, an actuating member on said shaft and being adapted to rotate a predetermined distance in one direction and the reverse thereof and being adapted to move said shaft during same portion of the rotational movements in each direction, movable stop means on said shaft, fixed stop means for engagement by said movable stop means, interengaging means between said shaft and said actuating member having one position for effective movement of said shaft upon movement of said actuating element until engagement of said fixed stop by said movable stop, whereupon relative movement in one direction occurs between said shaft and said actuating element, said interengaging means having a second position for effecting movement of said shaft in the reverse direction upon movement of said actuating element in the reverse to a predetermined position, and means for moving said interengaging means from said second position to said one position while holding said actuating member stationary.

5. In a gasoline service station pump actuating mechanism wherein during operation, the nozzle is removed from its recess, an actuating lever is rotated ninety degrees on a pump shaft in one direction to activate the pump during part of the lever rotation and to set the indicating dials to zero before flow takes place and in the reverse direction of the lever to an off position to deactivate the pump and to lock the lever in the off position to require the release of the lever lock before further pump activation can occur, the improvement for assuring that the indicating dials are set to zero when the activating lever is released comprising a lost motion connection between said pump shaft and said actuating lever, said lost motion connection comprising an abutment means on said shaft separating first and second lost motion connection areas and releasable means on said actuating lever for riding on said first lost motion connection area engaging said abutment means and causing said pump shaft to rotate upon rotation of said actuating lever, a movable stop on said pump shaft, a fixed stop on said pump, said movable stop being located relative to said fixed stop to effect engagement of said stops and discontinuance of pump shaft rotation partway during said ninety degree rotation of said actuating lever, continued rotational movements of said actuating lever disengaging said releasable means from said abutment means and shifting said releasable means to said second lost motion connection area on said pump shaft, on the reverse movement of said actuating lever said releasable means rides on said second lost motion connection area, engages said abutment means and causes said pump shaft to rotate to the pump off position while said releasable means remains on said second lost motion connection area, and means on said pump shaft for enabling said pump shaft to be rotated in the pump actuation direction while holding said actuating lever stationary, thereby to move said releasable means from said second lost motion connection area to said first lost motion connection area and setting said indicator dials to zero.

6. The improvement according to claim 5 wherein said lost motion connection comprises a sleeve fitting over and attached to said shaft, said sleeve including said abutment means, said two lost motion connection areas, one on each side of said abutment means.

7. The improvement according to claim 6 wherein said lost motion areas comprise flat surfaces.

8. The improvement according to claim 7 wherein said releasable means comprised a spring biased ball.

9. The improvement according to claim 8 wherein said actuating lever is attached to said sleeve by a pin through said lever and diametrical groove in said sleeve.

* * * * *